United States Patent [19]

Huang et al.

[11] Patent Number: 5,040,673

[45] Date of Patent: Aug. 20, 1991

[54] STATIONERY CASE HAVING A WHISTLE

[76] Inventors: Johnny Huang, F-1, No. 101, Sec. 2, Ho-Ping E. Road, Taipei; Tzai H. Huang, No. 5, Kuang-Ming Rd., San Chung City, Taipei, both of Taiwan

[21] Appl. No.: 547,507

[22] Filed: Jul. 2, 1990

[51] Int. Cl.[5] ..... A45C 11/34; G07F 11/10

[52] U.S. Cl. ..... 206/214; 116/139; 206/340; 206/371; 221/3; 221/212; 446/77; 446/139

[58] Field of Search ..... 206/214, 224, 338, 340, 206/350, 371, 372, 576, 804, 818, 341; 116/139; 221/3, 190, 210, 212; 312/35; 446/73, 77, 139

[56] References Cited

U.S. PATENT DOCUMENTS

| | | | |
|---|---|---|---|
| 1,686,233 | 10/1928 | Halliday | 116/139 |
| 2,544,114 | 3/1951 | Steinberg | 221/212 |
| 3,743,082 | 7/1973 | Herrmann | 206/338 |
| 3,750,868 | 8/1973 | Cooper | 206/338 |
| 4,058,209 | 11/1977 | Schmidt | 206/350 |
| 4,958,746 | 9/1990 | Wu | 221/210 X |

*Primary Examiner*—Bryon P. Gehman

*Attorney, Agent, or Firm*—Bucknam and Archer

[57] ABSTRACT

Disclosed is a stationery case for keeping writing materials, which comprises an ornament mounted on a compression spring which is fastened in the interior of the casing. The ornament has a magnet fastened therein and is pressed and released so that clips which are received inside a curved recess in the casing can be taken out of the casing and placed on a recessed surface portion on a cover at the top of the casing for ready use. A plurality of compartments are made inside the casing in the portion opposite to the curved recess for keeping a variety of writing materials. A whistle is fastened inside the casing and is controlled to make a sharp, clear sound during a downward stroke of the ornament.

4 Claims, 2 Drawing Sheets

STATIONERY CASE HAVING A WHISTLE

BACKGROUND OF THE INVENTION

The present invention relates to stationery cases and more particularly to a stationery case for keeping writing materials in which clips, thumb tacks or pins can be automatically taken up for use through press control and a sharp, clear sound will be produced during press control.

In an office where paper is used, a variety of writing materials may be frequently used. For keeping writing materials in place, a container or stationery case is generally used. However, it is very inconvenient to pick up a clip, thumb tack or pin from a regular container. More particularly while picking up a thumb tack or a pin from a container one's fingers may be easily hurt. There is also a type of stationery case for keeping writing materials, which has a magnet fastened around the top opening thereof to gather metal writing materials for use. However, the use of this type of stationery case is still not very practical because it must be frequently turned upside-down to permit the metal writing materials to be attracted by the magnet. During operation, one's hand can not be absolutely protected from injury.

SUMMARY OF THE INVENTION

The present invention provides a stationery case which can eliminate the afore-said problem. By means of press control, clips, thumb tacks or pins can be automatically taken out of the casing for ready use, by a magnet which is fastened in an ornament. During press control operation, a whistle is initiated to make a sharp, clear sound.

BRIEF DESCRIPTION OF THE INVENTION

The present invention will now be described by way of example, with reference to the annexed drawings, in which.

DESCRIPTION OF THE PREFERRED EMBODIMENT

Figure 1:
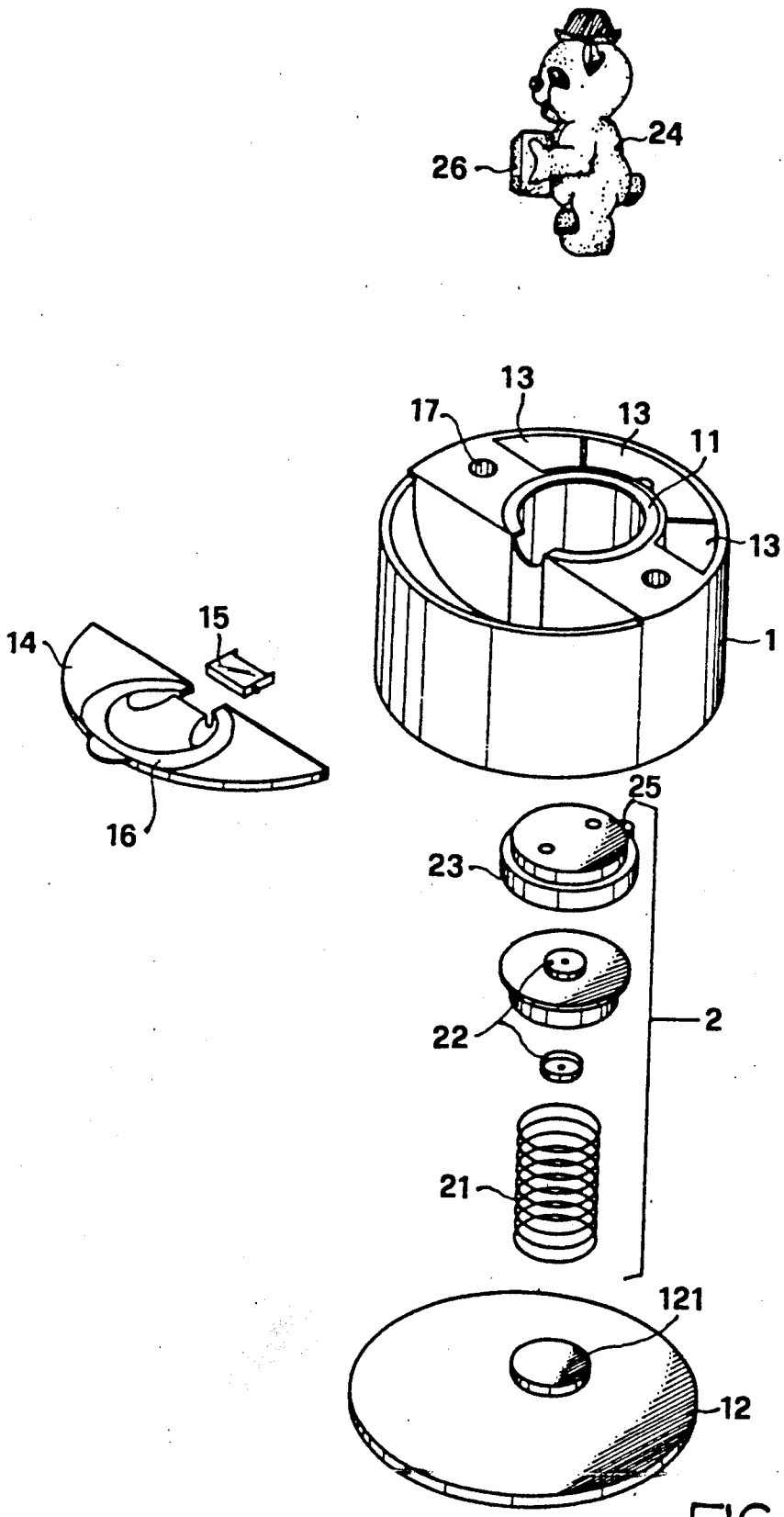
FIG. 1 is a perspective fragmentary view of the present invention.

Referring to the annexed drawings in greater detail, therein illustrated is a stationery case embodying the present invention and generally comprised of a casing 1 preferably designed in a geometric pattern having a round opening 11 at the center, and a bottom cap 12 having a projection 121 for holding a compression spring.

As illustrated, the casing 1 comprises internally a plurality of semi-closed compartments 13 at one side for keeping writing materials, and a curved recess at the opposite side and covered with a cover 14. The cover 14 comprises a strip 15 pivotably attached thereto at one side.

There is a press-control device 2 comprised of a compression spring 21 mounted on the projection 121 of the bottom cap 12, a whistle 22 and a press button 23. The press button 23 comprises a side projection held inside the top flange at the topmost edge of the round opening 11 to protect the press button 23 from breaking away. An ornament 24 is mounted on the top of the press button 23, which has a magnet 26 set at a position near the strip 15. The ornament 24 may be variously shaped as desired.

Figure 2:
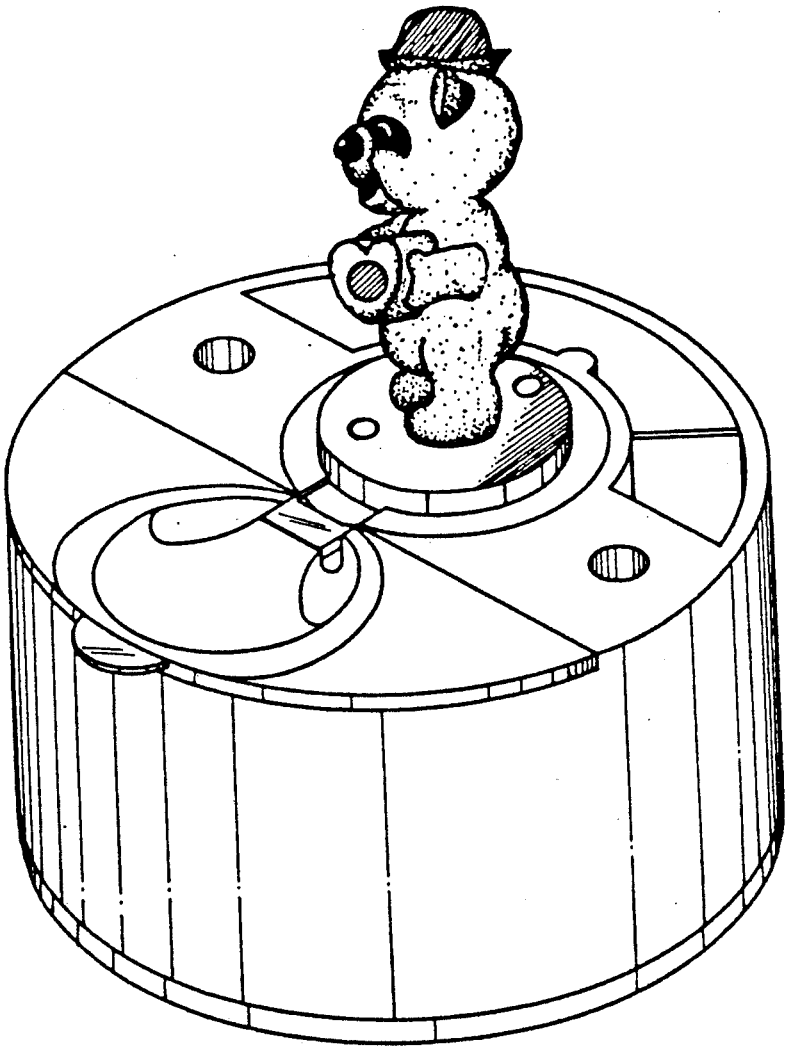
FIG. 2 is a schematic assembly view thereof.

Referring to FIG. 2, gem clips, thumb tacks or pins can be received inside the curved recess beneath the cover 14. When the ornament 24 is pressed down to a certain depth, the magnet 26 immediately attracts a clip. As soon as pressure force is released from the ornament 24, the compression spring 21 immediately pushes the ornament 24 to move back to the original upper position. At the same time, the clip which is taken by the magnet 26 is moved to the strip 15 for use. When the ornament 24 is pressed downward, the downward pressure will simultaneously force the whistle 22 to make a sharp, clear sound.

For continuous operation in taking up clips, thumb tacks or pins from the curved recess in the interior of the casing 1, a recessed portion 16 is preferably made on the top surface of the cover 14 for temporarily keeping clips, thumb tacks or pins. Further, a plurality of mounting orifices 17 may be made on the topmost edge of the casing 1 for holding pens.

As indicated, the present invention may be variously embodied. Recognizing that various modifications are apparent, the scope herein shall be deemed as defined in the claims set forth hereinafter.

We claim:

1. A stationery case, comprising:

a casing having a round orifice in the center, a bottom, a cap at the bottom, and a top, a projection in said cap, a compression spring being mounted on said projection and being disposed in said round orifice, a curved recess in the interior of said casing, a cover for said recess at one side thereof, said cover having a recessed surface portion at the its top, a press-button device comprising said compression spring, a whistle supported by said spring, a press-button mounted on said whistle at the top thereof and having a side projection movably fastened in the interior of said round orifice, and an ornament mounted on said press-button at the top thereof, said ornament having a magnet fastened therein at a position there of adjacent to said cover.

2. The stationery case according to claim 1 wherein said cover has a strip pivotally attached to one side thereof and said magnet is in a position adjacent to said strip.

3. The stationery case according to claim 1 wherein said casing comprises a plurality of compartments diametrically opposite to said curved recess.

4. The stationery case according to claim 1 wherein said casing comprises a plurality of orifices at the top thereof for holding pens.

* * * * *